US005150686A

United States Patent [19]

Okawa et al.

[11] Patent Number: 5,150,686

[45] Date of Patent: Sep. 29, 1992

[54] EVAPORATIVE FUEL CONTROL APPARATUS OF INTERNAL COMBUSTION ENGINE

[75] Inventors: Koji Okawa; Kazuhiko Norota, both of Toyota, Japan

[73] Assignee: Toyota Jidosha Kabushiki Kaisha, Toyota, Japan

[21] Appl. No.: 741,583

[22] Filed: Aug. 7, 1991

[30] Foreign Application Priority Data

Aug. 8, 1990 [JP] Japan ..... 2-211261

[51] Int. Cl.[5] ..... F02M 51/00

[52] U.S. Cl. ..... 123/698; 123/520

[58] Field of Search ..... 123/489, 520, 416, 417, 123/568

[56] References Cited

U.S. PATENT DOCUMENTS

| | | | |
|---|---|---|---|
| 4,841,940 | 6/1989 | Uranishi et al. | 123/520 |
| 4,926,825 | 5/1990 | Ohtaka et al. | 123/520 |
| 4,932,386 | 6/1990 | Unzumi et al. | 123/520 |
| 4,977,881 | 12/1990 | Abe et al. | 123/489 |
| 5,048,492 | 9/1991 | Davenport et al. | 123/489 |
| 5,048,493 | 9/1991 | Orzel et al. | 123/489 |
| 5,067,469 | 11/1991 | Hamburg | 123/520 |

FOREIGN PATENT DOCUMENTS

| | | |
|---|---|---|
| 0001857 | 1/1986 | Japan . |
| 0055357 | 3/1988 | Japan . |
| 0085249 | 4/1988 | Japan . |
| 0273864 | 11/1989 | Japan . |

*Primary Examiner*—Raymond A. Neill
*Attorney, Agent, or Firm*—Kenyon & Kenyon

[57] ABSTRACT

An evaporative fuel control apparatus of an internal combustion engine is provided with a purge correction prohibition part. The apparatus includes a detection part for detecting operating conditions of the internal combustion engine and for supplying signals indicative of the operating conditions, a purge control valve for controlling a flow of fuel vapor to an intake passage of the engine, a calculation part for calculating a fuel injection amount in response to the signals, and a fuel injection control part for varying a feedback correction factor of an air-fuel ratio in response to the signals so as to maintain the air-fuel ratio at a stoichiometric value and for correcting the fuel injection amount on the basis of the feedback correction factor. The apparatus also includes a purge correction part for correcting a purging amount of fuel vapor which is fed into the intake passage, in response to the feedback correction factor, so that the feedback correction factor is adjusted to be within a predetermined range, and a prohibition part for preventing the purge correction part from adjusting the purging amount of fuel vapor when the feedback correction factor is not within the predetermined range and it is determined in response to the signals that the feedback correction factor changes from a value outside the range to a value within the range.

7 Claims, 7 Drawing Sheets

| FAF | DPG | KPG |
|---|---|---|
| KFAFH< FAF | INCREASE | DECREASE |
| 1.0 ≦FAF≦KFAFH | INCREASE | NO CHANGE |
| KFAFL≦ FAF<1.0 | NO CHANGE | INCREASE |
| KFAFL> FAF | DECREASE | INCREASE |

EVAPORATIVE FUEL CONTROL APPARATUS OF INTERNAL COMBUSTION ENGINE

BACKGROUND OF THE INVENTION (1) Field of the Invention

The present invention generally relates to evaporative fuel control apparatus, and more particularly to an evaporative fuel control apparatus of an internal combustion engine for feeding fuel vapor from a fuel tank to an intake system through a purge passage in which a purge control valve is provided.

(2) Description of the Related Art

Conventionally, in an internal combustion engine, an evaporative fuel control apparatus has been used, which stores fuel vapor from a fuel tank by activated carbon of a canister and feeds the stored fuel vapor from the canister into an intake passage of the intake system of the internal combustion engine. The feeding of fuel vapor into the intake passage is called hereinafter the purging of fuel vapor. Also, there is a known internal combustion engine which has a fuel injection control part for performing a feedback control of an air-fuel ratio of air fuel mixture to control it convergently toward the stoichiometric air-fuel ratio. Conventionally, when the feedback control of the air-fuel ratio is performed, it is considered that a feedback correction factor FAF adjusts suitably the air-fuel ratio, and a description of the feedback correction factor or coefficient FAF is disclosed, for example, in the U.S. Pat. No. 4,841,940 assigned to the same assignee with the present invention, and the disclosure of this patent regarding the term "feedback correction coefficient" is hereby incorporated in the present specification for the sake of clarity.

Also, there is another internal combustion engine having a fuel control part which has been proposed by the same applicant, as disclosed in Japanese Laid-Open Patent Application No.63-55357. In the case of this prior art internal combustion engine, the feedback control of the air-fuel ratio is performed within a first range of the feedback correction factor. When the value of the feedback correction factor is within a given range which is slightly narrower than the first range in which the feedback control of the air-fuel ratio is performed, the amount of fuel vapor purged into the intake passage is corrected to increase gradually. When the value of the feedback correction factor is not within the above given range, the amount of fuel vapor purged is corrected to decrease it gradually, so that effective purging of fuel vapor is carried out to attain appropriate feedback control of the air-fuel ratio.

However, in the case of the above mentioned fuel control part of the internal combustion engine, there is a problem in that the amount of fuel vapor being purged is occasionally excessively adjusted, causing the response of the feedback control of the air-fuel ratio to become worse. This is because the purging amount of fuel vapor is adjusted merely by making a determination as to whether the value of the feedback correction factor is within the given range or not. For example, when the feedback correction factor changes from a value outside a rich-side range between 1.0 and a given high reference level to a value within the rich-side range, the amount of fuel vapor purged, in the case of the prior art apparatus, is unnecessarily adjusted to decrease it. Accordingly, the amount of the correction performed to correct the air-fuel ratio by the feedback control will be excessive so that the air fuel ratio will be adjusted to an excessive level, thus causing the feedback control of the air-fuel ratio in response to the changes in the operating conditions becomes less accurate and slower.

SUMMARY OF THE INVENTION

Accordingly, it is a general object of the present invention to provide an improved evaporative fuel control apparatus in which the above described problems of the prior art apparatus are eliminated.

Another and more specific object of the present invention is to provide an evaporative fuel control apparatus in which the amount of fuel vapor purged into the intake passage is prevented from being corrected unnecessarily by the purge correction part, to prevent the air-fuel ratio from being adjusted to an excessive level, when the feedback correction factor changes from a value outside a predetermined range to a value within the range. The above mentioned object of the present invention can be achieved by an evaporative fuel control apparatus which comprises a detection part for detecting operating conditions of an internal combustion engine and for supplying signals indicative of the operating conditions of the engine, a purge part for controlling a flow of fuel vapor from a fuel tank into an intake passage of the internal combustion engine, a calculation part for calculating a fuel injection amount in response to the signals supplied by the detection part, a fuel injection control part for varying a feedback correction factor of an air-fuel ratio of air fuel mixture, in response to the signals supplied by the detection part, so as to maintain the air-fuel ratio at a stoichiometric value, and for correcting the fuel injection amount calculated by the calculation part on the basis of the varied feedback correction factor, a purge correction part for correcting a purging amount of fuel vapor which is fed by the purge part into the intake passage, in response to the feedback correction factor varied by the fuel injection control part, so that the feedback correction factor is adjusted to be within a predetermined range, and a prohibition part for preventing the purge correction part from correcting the purging amount of fuel vapor when the feedback correction factor is not within the predetermined range and it is determined from the signals supplied by the detection part that the feedback correction factor has changed from a value outside the predetermined range to a value within the predetermined range. According to the present invention, it is possible to control the air-fuel ratio accurately and quickly in response to changes in the operating conditions of the engine. When the purge correction part varies the purging amount of fuel vapor so that the feedback correction factor is within the predetermined range and the air-fuel ratio is maintained at the stoichiometric value, the prohibition part prevents the purge correction part from correcting the purging amount of fuel vapor when the feedback correction factor changes from a value outside the predetermined range to a value within the predetermined range, thereby eliminating excessive decrease or increase of the purging amount of fuel vapor. Especially when the feedback correction factor changes from a value outside a rich-side range to a value within the rich-side range, it is possible for the present invention to prohibit the purge correction part from excessively decreasing the purging amount of fuel vapor to attain accurate and speedy feedback control of the air-fuel ratio in response to the changes in the opearting conditions of the engine. Therefore, the adsorbinq capacity of the canister recovers quickly and the internal combustion engine exhibits better fuel consumption.

Other objects and further features of the present invention will become more apparent from the following detailed description when read in conjunction with the accompanying drawings.

DESCRIPTION OF THE PREFERRED EMBODIMENT

Figure 1:
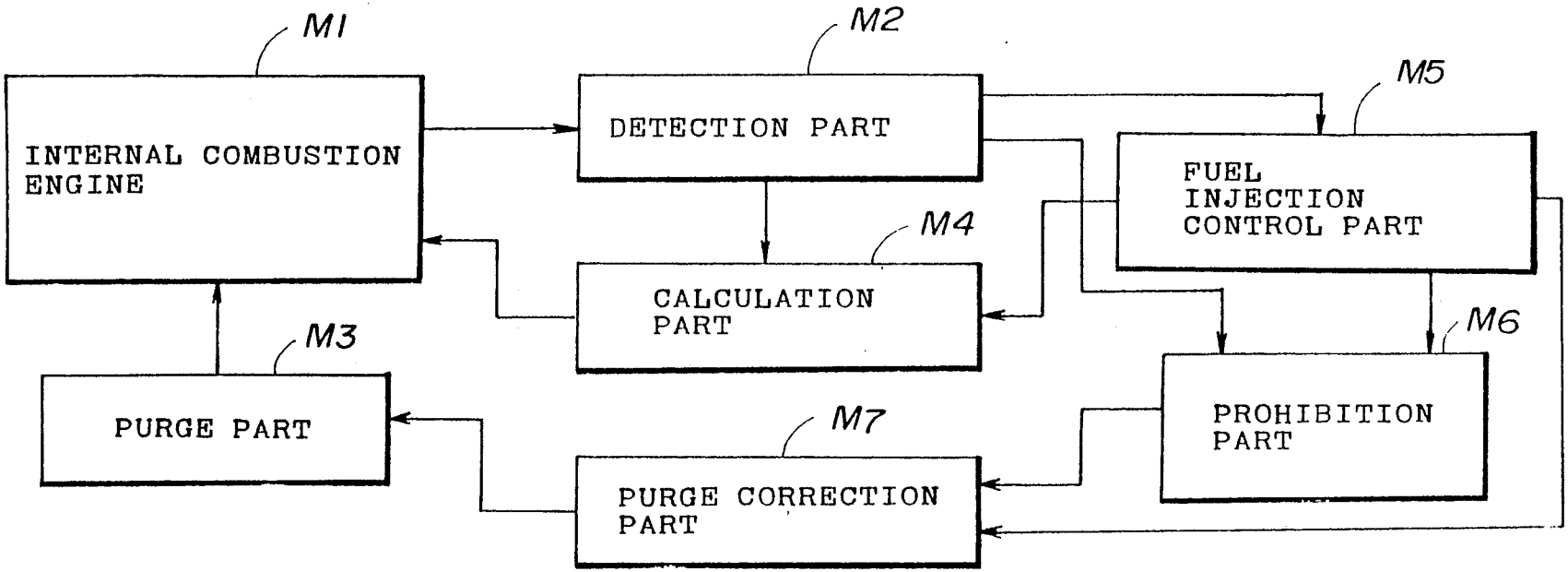
FIG.1 is a block diagram showing a construction of an embodiment of an evaporative fuel control apparatus according to the present invention.

First, a description will be given of an embodiment of an evaporative fuel control apparatus according to the present invention, with reference to FIG.1. FIG.1 shows the embodiment of the evaporative fuel control apparatus according to the present invention. The evaporative fuel control apparatus shown in FIG.1 generally has an internal combustion engine M1, a detection part M2, a purge part M3, a calculation part M4, a fuel injection control part M5, a prohibition part M6 and a purge correction part M7. The detection part M2 detects operating conditions of the internal combustion engine M1 and supplies detection signals indicative of the operating conditions of the engine. The purge part M3 controls the flow of fuel vapor being purged into an intake passage from a fuel tank. The calculation part M4 calculates the amount of fuel injected into a combustion chamber of the internal combustion engine M1 in response to the detection signals supplied by the detection part M2. The fuel injection control part M5 varies a feedback correction factor of an air-fuel ratio of an intake air fuel mixture in response to the detection signals supplied by the detection part M2 so as to invariably maintain the air-fuel ratio at the stoichiometric value, thereby adjusting the amount of fuel injected, which amount is calculated by the calculation part M2. The purge control part M7 corrects the amount of fuel vapor purged by the purge part M3 in response to the feedback correction factor varied by the fuel injection control part M5 so that the feedback correction factor falls within a predetermined range. And, the prohibition part M6 prevents the purge correction part M7 from correcting the amount of fuel vapor purged when a value of the feedback correction factor is not in the predetermined range and it is determined from the detection signal supplied by the detection part M2 that the feedback correction factor has been changed from the value outside the predetermined range to a value within the predetermined range.

Figure 2:
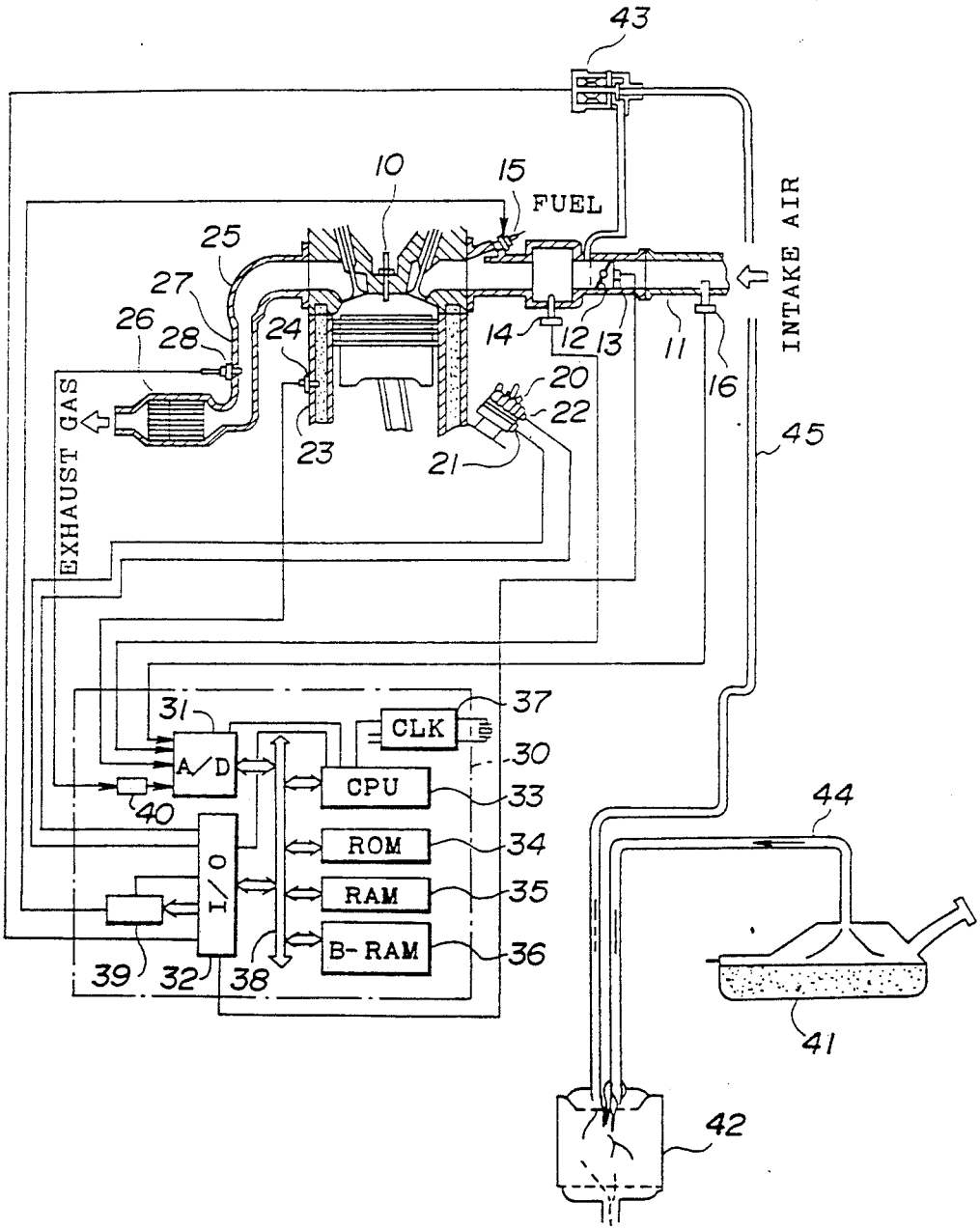
FIG.2 is a schematic view showing an internal combustion engine to which the evaporative fuel control apparatus of the present invention is applied.

Next, a description will be given of an internal combustion engine to which an embodiment of the evaporative fuel control apparatus of the present invention is applied. In FIG.2, this internal combustion engine 10 has an intake passage 11 in which a throttle valve 12 is provided, and on a shaft of the throttle valve 12 a throttle position sensor 13 is mounted for sensing a valve opening position of the throttle valve 12 which is rotated around the shaft thereof. Downstream of the throttle position sensor 13 in the intake passage 11, a pressure sensor 14 is provided for measuring pressure of intake air entering the intake passage 11. Downstream of the pressure sensor 14 in the intake passage 11, a fuel injection valve or fuel injector 15 is provided for each of cylinders of the internal combustion engine 10, to supply fuel under pressure from a fuel supply system to an intake port of the engine 10. The intake passage 11 includes an intake air temperature sensor 16 provided therein for supplying an analog signal of a voltage in response to the temperature of the intake air to an A/D (analog-to-digital) converter 31 in an electronic control unit 30.

The internal combustion engine 10 includes a distributer 20, and in this distributer 20 there are provided two crank angle sensors 21, 22, the crank angle sensor 21 supplying a reference pulse signal to an I/0 interface 32 of the electronic control unit 30 each time a shaft of the distributer 20 is rotated by 720 CA degrees (CA refers to engine crank angle), and the crank angle sensor 22 supplying a reference pulse signal to the I/0 interface 32 each time the distributer shaft is rotated by 30 CA degrees. These reference pulse signals from the two sensors 21, 22 are used as request signals for interruption of fuel injection timing, request signals for interruption of timing signal for spark timing or request signals for interruption of fuel injection control.

In a cooling water passage 23 of the internal combustion engine 10, a water temperature sensor 24 is provided for sensing the temperature of cooling water, and the water temperature sensor 24 supplies an analog signal THW indicative of the temperature of the cooling water to the A/D converter 31.

In an exhaust system which is provided downstream of an exhaust manifold 25, a three-way catalytic converter 26 is mounted for oxidizing and reducing three major pollutants in exhaust gas, HC, CO, NOx from the exhaust manifold 25 to decrease the ratio of harmful components to the exhaust gas. In an exhaust pipe 27 between the exhaust manifold 25 and the catalytic converter 26, an oxygen sensor 28 is mounted to detect a concentration of oxygen in the exhaust gas flowing out from the combustion chamber of the internal combustion engine to the exhaust pipe 27. The oxygen sensor 28 generates an output signal of a voltage in accordance with the oxygen concentration of the exhaust gas, and supplies the same to the A/D converter 31 of the electronic control unit 30 via a signal processing circuit 40. The voltage of this output signal supplied by the oxygen sensor 28 is varied between two different voltages, depending on whether the air fuel mixture is lean or rich in comparison with the stoichiometric air-fuel ratio. In addition, an ON/OFF signal of a key switch (not shown) is supplied to the I/0 interface 32 when the key switch is turned ON and OFF, and an output signal of an engine speed sensor (not shown) is supplied to the A/D converter 31, this output signal being an analog signal of a voltage proportional to an engine speed of the internal combustion engine 10.

In the internal combustion engine 10 thus constructed, an evaporative emission control system is provided to prevent fuel vapor from a fuel tank 41 from escaping to the atmosphere. This evaporative emission control system has a charcoal canister 42 and an electric vacuum switching valve (hereinafter called a VSV) 43 which is provided as the purge part M3 of the evaporative fuel control apparatus of the present invention. The charcoal canister 42 is connected to the fuel tank 41 by a vapor collecting conduit 44, and this vapor collecting conduit 44 projects from a top of the fuel tank 41, so that fuel vapor evaporated from the fuel tank 41 is adsorbed by activated carbon of the charcoal canister 42. A vapor supply conduit 45 is provided so as to connect the charcoal canister 42 to the intake passage 11, so that the fuel vapor adsorbed by the charcoal canister 42 is returned to a portion of the intake passage 11 downstream of the throttle valve 12 provided therein. The VSV 43 is a kind of an electromagnetic control valve which is opened and closed in response to a signal supplied by the electronic control unit 30, and the VSV 43 is mounted at an intermediate portion of the vapor supply conduit 45 between the charcoal canister 42 and the intake passage 11 to control the flow of fuel vapor from the charcoal canister 42 to the intake passage 11 through the vapor supply conduit 45.

When the key switch (not shown) is turned ON, the electronic control unit 30 starts to execute a control program stored therein so that several output signals are received from the above described sensors and the operation of the fuel injection valve 15 and the other actuators is controlled by the electronic control unit 30.

The electronic control unit 30 comprises, for example, a microcomputer, and this electronic control unit 30 includes the A/D converter 31, the I/0 interface 32, the CPU 33, a ROM (read only memory) 34, a RAM (random access memory) 35, a backup RAM 36 retaining information stored therein after the key switch is turned OFF, a CLK (clock) 37, and a bidirectional bus 38 interconnecting the above mentioned parts of the electronic control unit 30 as shown in FIG.2.

The fuel injection control circuit 39 in the electronic control unit 30 includes a down counter, a flipflop and a drive circuit, and this fuel injection control circuit 39 controls the operation of the fuel injection valve 15. A basic injection time Tp is calculated based on the intake air pressure and the engine speed, and this basic injection time Tp is corrected in response to the operating conditions of the internal combustion engine 10 supplied from the above described sensors and a fuel injection time TAU is calculated. This fuel injection time TAU is supplied to the down counter of the injection control circuit 39. Then, the fuel injection time TAU is preset to the down counter of the circuit 39, and the flipflop thereof is switched so that the drive circuit of the injection control circuit 39 starts to operate the fuel injection valve 15. On the other hand, the down counter performs a counting of clock signals (not shown) until an output terminal of the down counter is finally set at a high level or "1" level. When the output terminal of the down counter is set at the high level, the flipflop is reset so that the drive circuit stops activation of the fuel injection valve 15. In other words, the fuel injection valve 15 is opened to feed the fuel amount to a combustion chamber of the internal combustion engine 10, and the amount of fuel injected to the combustion chamber is proportional to the above fuel injection time TAU thus calculated.

Next, a description will be given of a control program for controlling the operation of the vacuum switching valve (VSV) 43, and this controlling is performed by the purge correction part M7 of the present invention. The electronic control unit 30 supplies a pulse signal to the VSV 43, the pulse signal having a duty factor DPG which is varied at a given frequency. When the pulse signal supplied by the electronic control unit 30 to the VSV 43 is at a high level, the VSV 43 is opened to purge fuel vapor into the intake system. The amount of fuel vapor purged is varied in proportion to the duty factor DPG of the pulse signal supplied by the electronic control unit 30 to the VSV 43. Therefore, it is possible to suitably control the amount of fuel vapor purged into the intake system, by changing the duty factor DPG of the pulse signal supplied to the VSV 43.

Figure 3:
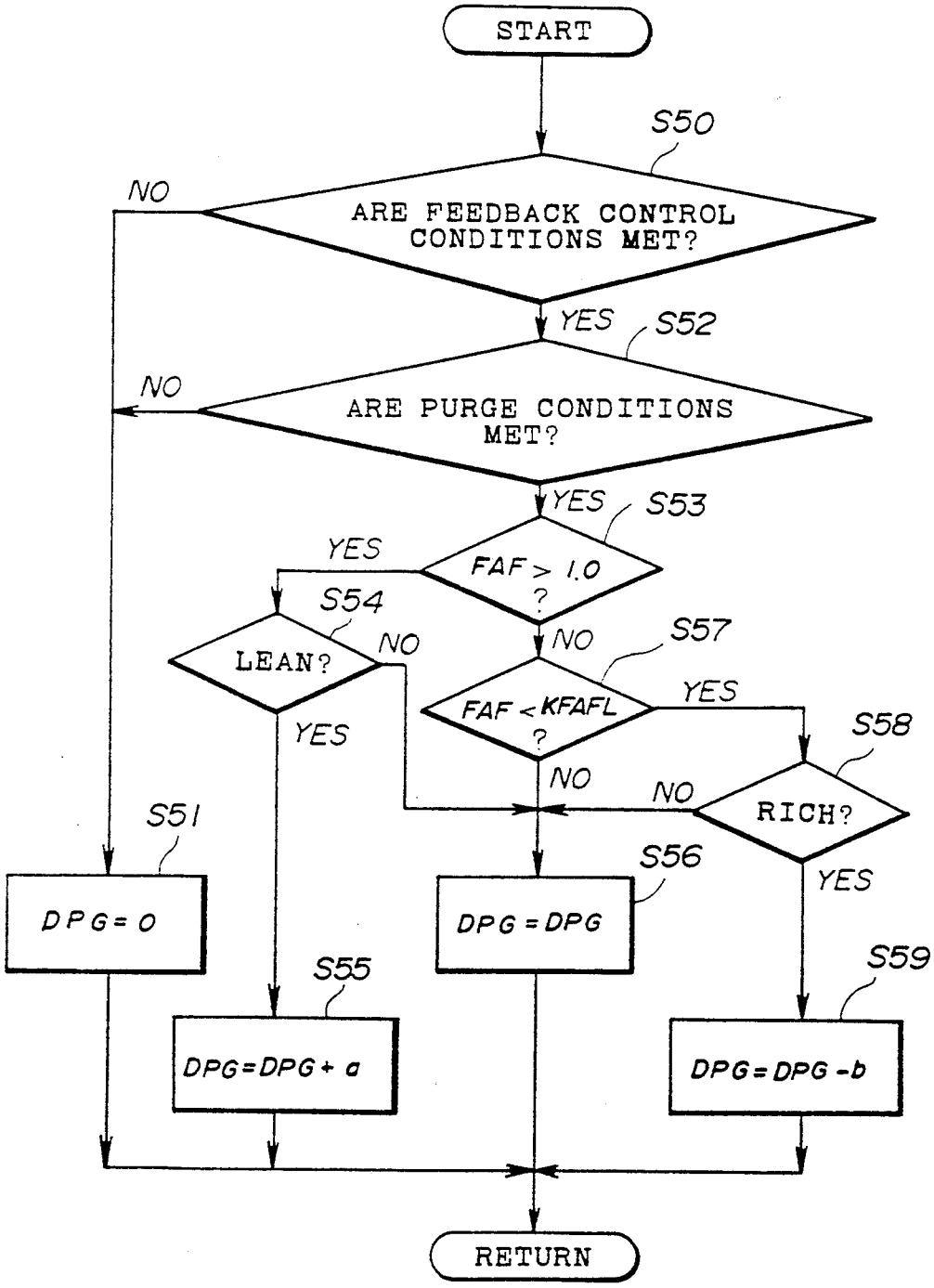
FIG.3 is a flow chart for explaining a purge valve control routine which is carried out by the evaporative fuel control apparatus of the present invention.

FIG.3 shows a VSV controlling routine for controlling the operation of the VSV 43, and this controlling is performed by the purge correction part M7. The VSV controlling routine is executed only when the average value FAFav of a feedback correction factor FAF meets a requirement which is represented by the formula: $0.95 < FAFav < 1.05$. The execution of the VSV controlling routine may be made by an interrupt at time intervals of one second, for example. In this case, once the average value FAFav has met the above requirement, the VSV controlling routine is continuously carried out, that is, the execution of the VSV controlling routine is not hindered even when the average feedback correction factor does not meet the requirement at a later time.

In the purge valve controlling routine shown in FIG.3, in a step S50, a determination is made as to whether feedback control conditions are met by the internal combustion engine. The feedback control conditions include: (1) the cooling water temperature is higher than a given level; (2) the engine is not in the idling condition; (3) the engine is not running in the heavy load condition; and (4) the engine is not in the fuel cut condition. If any of the feedback control conditions is not met, then the duty factor DPG is set to zero in a step S51 so that the purging of fuel vapor is stopped. If all the above mentioned feedback control conditions are met, then a determination is made as to whether purge conditions are met by the internal combustion engine in a step S52. The purge conditions include: (1) more than 30 seconds elapse after the engine starts idling; (2) more than 5 seconds elapse after the idling switch is turned ON; (3) the vehicle speed is higher than 2 km/h; and (4) the intake air temperature is higher than 45 deg C. If any of the above mentioned purge conditions is not met, then the duty factor DPG is set to zero in the step S51.

When the feedback control conditions are met and the purge conditions are met, a determination is made whether the value of the feedback correction factor FAF is greater than 1.0 in a step S53. If the value of the FAF is greater than 1.0, then, in a step S54, a determination is made whether the air fuel mixture is lean on the basis of an output signal of the oxygen sensor 28. When it is detected that the air fuel mixture is lean, the value of the duty factor DPG is incremented by a given quantity "a" in a step S55. This given quantity "a" is equivalent to, for example, 10% of the value of the duty factor DPG. When it is detected that the air fuel mixture is rich in the step S58, the duty factor DPG is not changed in a step S56.

According to the present invention, the duty factor DPG is incremented by a given quantity "a" to increase the amount of fuel vapor purged, only when the feedback correction factor FAF is greater than 1.0 and the output signal of the oxygen sensor 28 indicates that the air fuel mixture is lean and the FAF changes to a value outside a lean-side range between 1.0 and the KFAFH in which the fuel injection amount should be adjusted to increase it. On the other hand, when the feedback correction factor FAF is greater than 1.0 but the output signal of the oxygen sensor 28 indicates that the air fuel mixture is rich and that the FAF changes to a value within the lean-side range, the prohibition part M6 of the present invention serves to prevent the duty factor DPG from being incremented further, so that the duty factor DPG is not adjusted in order to increase the amount of fuel vapor purged.

When the feedback correction factor FAF is not greater than 1.0 in the step S53, the value of the FAF is compared with a predetermined reference level KFAFL in a step S57. This reference level KFAFL may be equal to 0.95, for example. If the value of the FAF is greater than the predetermined reference level KFAFL and smaller than 1.0, then the value of the duty factor DPG remains unchanged in the step S56. If the value of the FAF is smaller than the KFAFL, then a determination is made whether or not an output signal of the oxygen sensor 28 indicates that the air fuel mixture is rich in a step S58. If the air fuel mixture is determined to be lean in the step S58, then the value of the duty factor DPG remains unchanged in the step S56. If the mixture is determined to be rich in the step S58, then the value of the duty factor DPG is decremented by a given quantity "b" in a step S59. This given quantity "b" is equivalent to, for example, 5% of the value of the duty factor DPG.

According to the present invention, the duty factor DPG is decremented by a given quantity "b" to decrease the amount of fuel vapor purged, only when the feedback correction factor FAF is smaller than the predetermined low reference level KFAFL and the output signal of the oxygen sensor 28 indicates that the air fuel mixture is rich and that the FAF still changes to a value outside a rich-side range in which the fuel injection amount should be adjusted in order to decrease it. On the other hand, when the feedback correction factor FAF is smaller than the predetermined low reference level KFAFL but the output signal of the oxygen sensor 28 indicates that the air fuel mixture is lean and that the FAF changes to a value within the rich-side range between the KFAFL and 1.0, the prohibition part M6 serves to prevent the duty factor DPG from being decremented further, so that the duty factor DPG is not adjusted in order to decrease the amount of fuel vapor purged unnecessarily.

Figure 4:
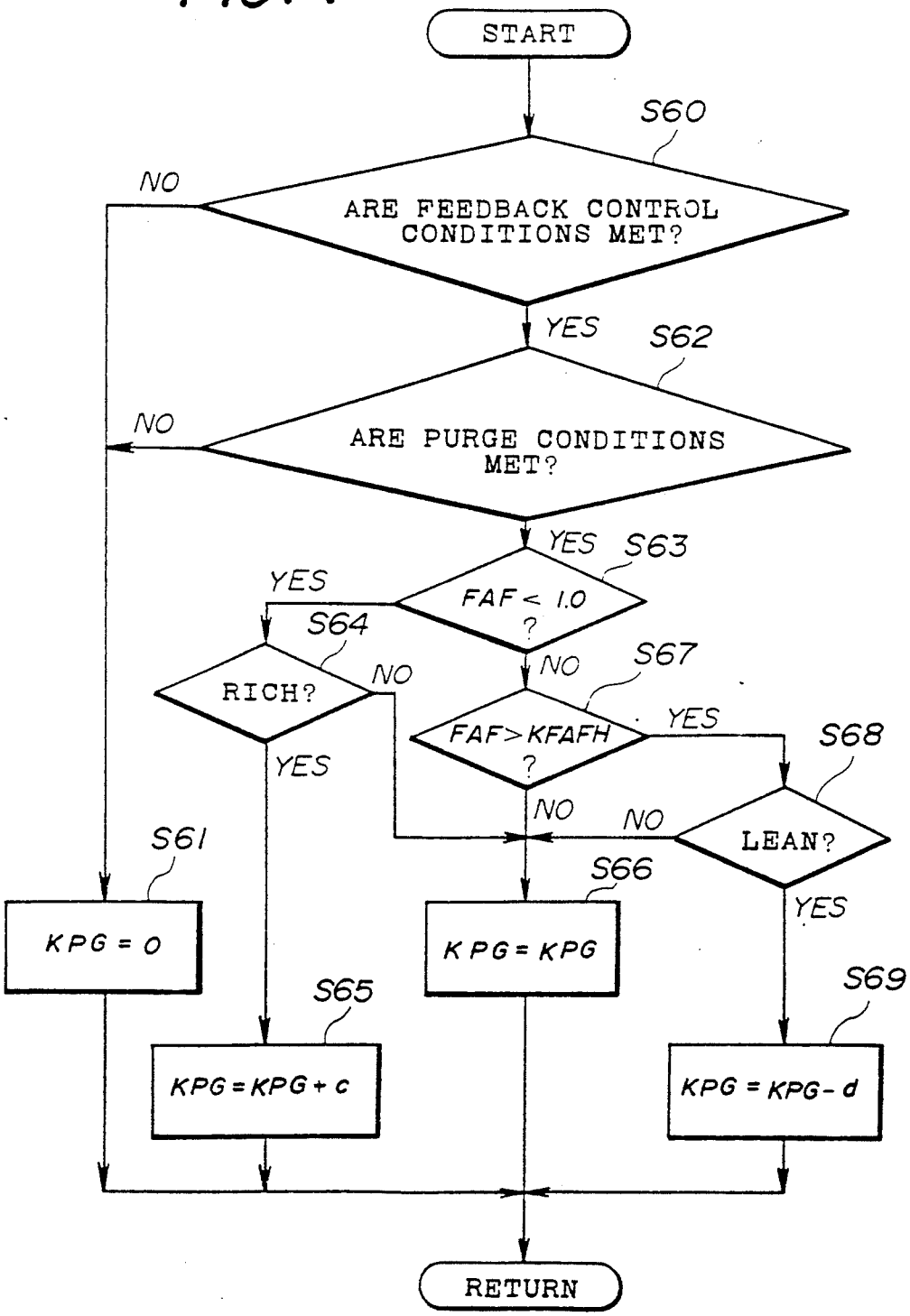
FIG.4 is a flow chart for explaining a calculation routine performed by the evaporative fuel control apparatus for calculating a purge correction amount.

FIG.4 shows a calculation routine for calculating the purge correction amount. The purge correction amount is hereinafter referred to as the amount of correction needed to correct the amount of fuel injected, due to the purging of fuel vapor performed by the VSV 43 into the intake passage 11. This calculation routine may be executed by an interrupt at time intervals of, for example, 65 msec. In the calculation routine shown in FIG.4, in a step S60, a determination is made whether the feedback control conditions are met by the internal combustion engine 11. The feedback control conditions in this case are the same as those described above. If any of the feedback control conditions is not met, then a purge correction amount KPG is set to zero in a step S61. This purge correction amount KPG is the amount of correction needed to correct the amount of fuel injected due to the purging of fuel vapor. The purge correction amount KPG set to zero in the step S61 is equivalent to the correction amount when the engine runs at a reference idling speed which is, for example, 600 revolutions per minute (rpm).

If all the above feedback control conditions are met in the step S60, then a determination is made whether the purge conditions are met by the internal combustion engine in a step S62. The purge conditions are the same as described above. If any of the above purge conditions is not met, the purge correction amount KPG is set to zero in the step S61.

When both the feedback control conditions and the purge conditions are met, a determination is made whether the value of the feedback correction factor FAF is smaller than 1.0 in a step S63. If the value of the FAF is smaller than 1.0 , then a determination is made whether the air fuel mixture is rich on the basis of an output signal of the oxygen sensor 28 in a step S64. If it is detected that the air fuel mixture is rich in the step S64, then the purge correction amount KPG is incremented by a given quantity "c" in a step S65. This given quantity "c" is equal to, for example, 5 μsec. If it is detected that the air fuel mixture is lean in the step S64 based on the output signal of the oxygen sensor 28, then the purge correction amount KPG remains unchanged in a step S66.

According to the present invention, the purge correction amount KPG is incremented by a given quantity "c" to decrease the fuel injection amount, only when the feedback correction factor FAF is smaller than 1.0 and the output signal of the oxygen sensor 28 indicates that the air fuel mixture is rich and that the FAF changes to a value outside a rich-side range of between the KFAFL and 1.0 within which the fuel injection amount should be decreased. On the other hand, when the FAF is smaller than 1.0 but the output signal of the oxygen sensor 28 indicates that the air fuel mixture is lean and that the FAF changes to a value within the rich-side range, the prohibition part M6 of the present invention serves to prevent the purge correction amount KPG from being incremented further, so that the purge correction amount KPG is not adjusted in order to decrease the fuel injection amount unnecessarily.

When the feedback correction factor FAF is not smaller than 1.0 in the step S63, the value of the FAF is compared with a predetermined reference level KFAFH in a step S67. The value of this reference level KFAFH may be equal to 1.05, for example. If the value of the FAF is smaller than the predetermined reference level KFAFH and greater than 1.0, then the value of the purge correction amount KPG remains unchanged in the step S66. If the value of the FAF is greater than the KFAFH, then a determination is made whether the output signal of the oxygen sensor 28 indicates that the air fuel mixture is lean, in a step S68. If it is detected that the air fuel mixture is rich in the step S68, then the purge correction amount KPG remains unchanged in the step S66. If it is detected that the air fuel mixture is lean, then the purge correction amount KPG is decremented by a given quantity "d" in a step S69. This given quantity "d" is equal to, for example, 5 μsec.

According to the present invention, the purge correction amount KPG is decremented by a given quantity "d" to increase the fuel injection amount, only when the feedback correction factor FAF is greater than the high reference level KFAFH and the output signal of the oxygen sensor 28 indicates that the air fuel mixture is lean and that the FAF changes to a value outside the lean-side range of between 1.0 and the KFAFH within which the fuel injection amount should be increased. On the other hand, when the FAF is greater than the KFAFH and the output signal of the oxygen sensor 28 indicates that the air fuel mixture is rich and that the FAF changes to a value within the lean-side range, the prohibition part M6 serves to prevent the purge correction amount KPG from being decremented further, so that the fuel injection amount is not adjusted in order to increase the fuel injection amount unnecessarily.

Figures 5, 6:
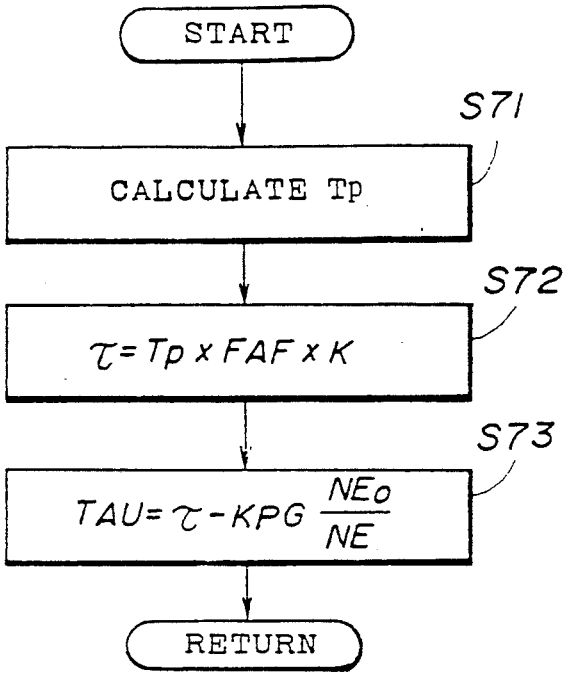
FIG.5 is a flow chart for explaining a calculation routine performed by the evaporative fuel control apparatus for calculating a fuel injection amount.
FIG.6 is a table for explaining a relationship between a duty factor and a purge correction amount with respect to a feedback correction factor.

FIG. 5 shows a calculation routine for calculating the amount of fuel injected, which is processed by the calculation part M4. In this calculation routine shown in FIG. 5, a basic fuel injection amount Tp is calculated on the basis of an intake air pressure PM and an engine speed NE in a step S71. The intake air pressure PM and the engine speed NE are detected and supplied by the related sensors to the electronic control unit 30. In a step S72, a fuel injection amount $\tau$, before the feedback correction is made, is determined from the basic fuel injection amount Tp in the step S71, the feedback correction factor FAF and a given coefficient K by the following formula:

$$\tau = Tp \times FAF \times K \quad (1)$$

The determination of the fuel injection amount $\tau$ in the step S72 is performed by the injection control part M5 of the present invention. In a step S73, the actual fuel injection time TAU after the feedback correction is determined from the fuel injection amount $\tau$ in the step S72, the purge correction amount KPG, a reference idling speed NEO and the engine speed NE, by the following formula:

$$TAU = \tau - (KPG \times NEO/NE) \quad (2)$$

The purge valve controlling routine shown in FIG.3 and the purge correction amount calculation routine shown in FIG.4 are thus carried out according to the present invention. FIG.6 shows a relationship between the duty factor DPG and the purge correction amount KPG with respect to the feedback correction factor FAF. As shown in FIG.6, the duty factor DPG and the purge correction amount KPG are varied depending on the value of the feedback correction factor FAF as described above. When the value of the feedback correction factor FAF is greater than the predetermined high reference level KFAFH, the duty factor DPG is increased and the purge correction amount DPG is decreased. When the value of the FAF is smaller than the predetermined high reference level KFAFH and greater than 1.0 , the duty factor DPG is increased and the purge correction amount KPG remains unchanged. When the value of the FAF is smaller than 1.0 and greater than the predetermined low reference level KFAFL, the duty factor DPG remains unchanged and the purge correction amount KPG is increased. And, when the value of the feedback correction factor FAF is smaller than the reference level KFAFL, the duty factor DPG is decreased and the purge correction amount KPG is increased.

Figure 7:
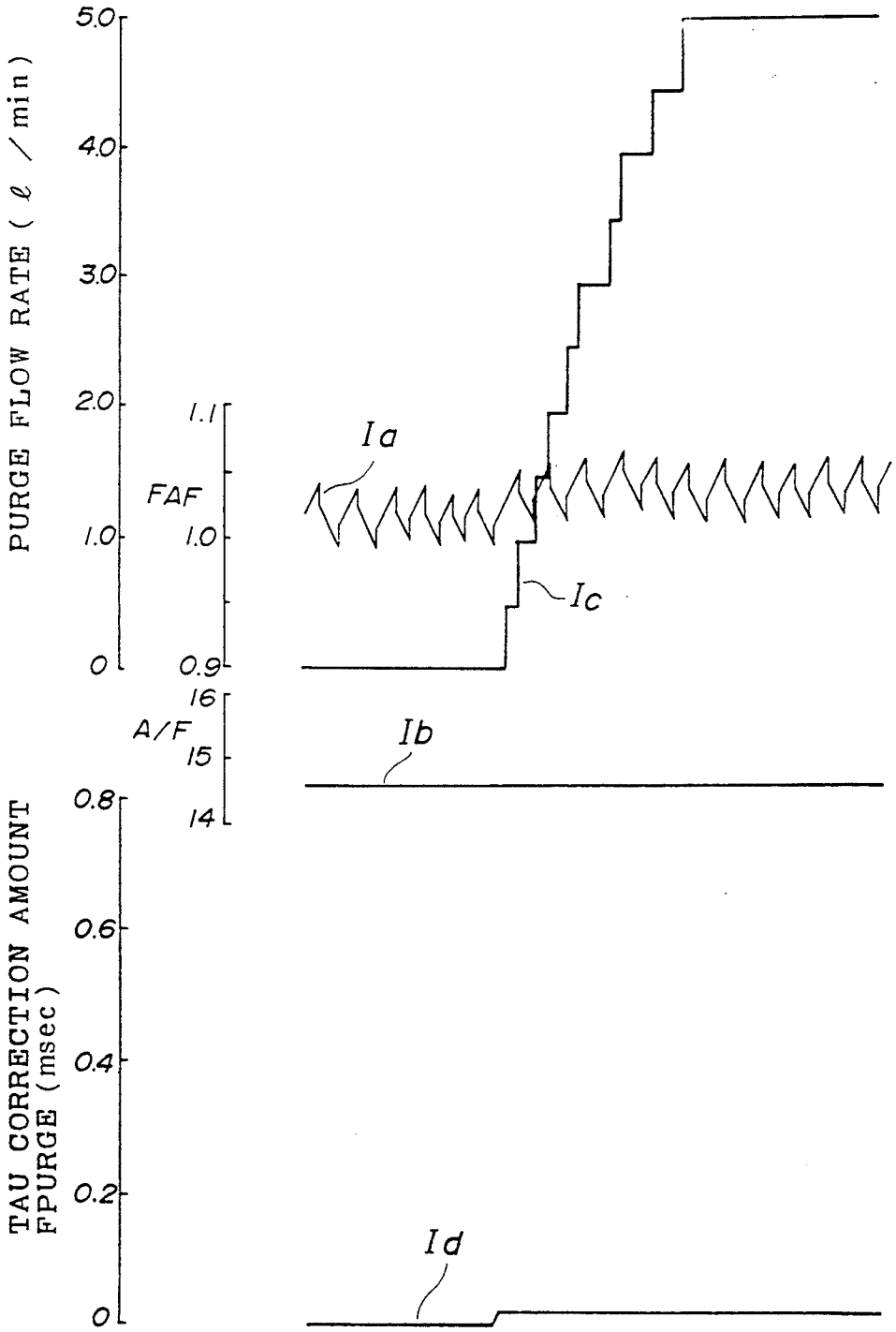
FIGS.7 and 8 are timing charts for explaining control operations performed by the evaporative fuel control apparatus to adjust the purge correction amount.

FIG.7 shows a case in which the amount of fuel vapor contained in the charcoal canister 42 is small and a concentration of fuel vapor purged to the intake passage 11 is low. As shown in a time chart in FIG.7, when the value of the feedback correction factor FAF, indicated by a solid line Ia in FIG.7, is greater than 1.0, and an output signal of the oxygen sensor indicates that the air fuel mixture is lean (the air-fuel ratio A/F of the air fuel mixture is indicated by a solid line Ib in FIG.7), the duty factor DPG is increased so that fuel vapor contained in the charcoal canister 42 is increasingly supplied to the intake passage 11 and the purging amount of fuel vapor purged into the intake passage 11 is rapidly increased, as indicated by a solid line Ic in FIG.7. In this case, the feedback correction factor FAF does not become smaller than the predetermined lower reference level KFAFL because the concentration of fuel vapor is low. According to the present invention, the duty factor DPG is increased and the purging amount of fuel vapor is also increased when the feedback correction factor FAF is greater than 1.0. And, the feedback correction factor FAF rarely exceeds the predetermined high reference level KFAFH, the purge correction amount KPG remains almost unchanged, and a TAU correction amount FPURGE (=KPG×NEO/NE) is not increased and is instead kept at a relatively low level, as indicated by a solid line Id in FIG.7.

Figure 8:
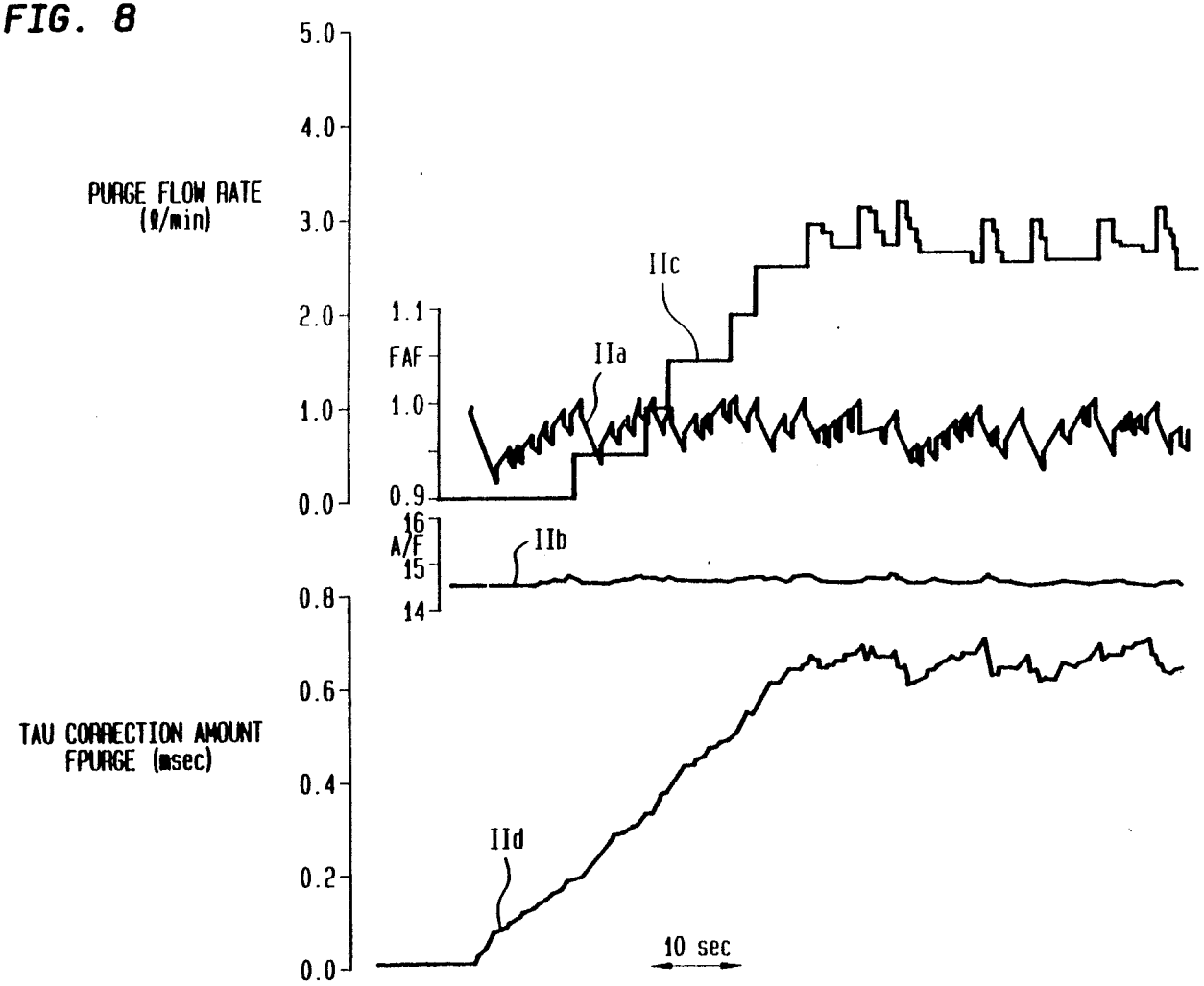

FIG.8 shows a case in which the amount of fuel vapor contained in the charcoal canister 42 is very great and the concentration of fuel vapor purged to the intake passage 11 is high. As shown in a time chart in FIG.8, when the value of the feedback correction factor FAF, indicated by a solid line IIa in FIG.8, exceeds 1.0, and an output signal of the oxygen sensor indicates that the air fuel mixture is lean (the air-fuel ratio A/F of the air fuel mixture is indicated by a solid line IIb in FIG.8), the duty factor DPG is increased so that fuel vapor contained in the charcoal canister 42 is increasingly supplied to the intake passage 11 and the purging amount of fuel vapor is rapidly increased as indicated by a solid line Ic in FIG.7. In this case, the concentration of fuel vapor is high, and, when the feedback correction factor FAF is greater than 1.0, the duty factor DPG is increased and the purging amount of fuel vapor is increased. When the feedback correction factor FAF is smaller than 1.0 and an output signal of the oxygen sensor indicates that the air fuel mixture is rich, the purge correction amount KPG, or the TAU correction amount FPURGE, is rapidly increased as indicated by a solid line IId in FIG.8. However, in this case, the concentration of fuel vapor is high. According to the present invention, when the feedback correction factor FAF is smaller than the predetermined low reference level KFAFL and the output signal of the oxygen sensor indicates that the air fuel mixture is rich, the duty factor is decreased and the purging amount of fuel vapor is decreased, thereby eliminating the increase of the purge correction amount KPG, or eliminating the increase of the TAU correction amount.

As described above, according to the present invention, the purging amount of fuel vapor is controlled to increase it when the feedback correction factor FAF is varied so that is approaches a predetermined low reference level KFAFL which is set at below 1.0, and when the feedback correction factor FAF is varied so that it approaches a predetermined high reference level KFAFH which is set at above 1.0, the purging amount of fuel vapor is adjusted in order to decrease it. Therefore, the purging amount of fuel vapor is suitably adjusted so as to invariably maintain the air-fuel ratio at the stoichiometric value, thereby preventing an excessive amount of purging correction from being made. Also, according to the present invention, when the feedback correction factor FAF is varied from a rich-side level near the predetermined high reference level KFAFH to a lean-side level near the predetermined low reference level KFAFL, the purging amount of fuel vapor is not allowed to decrease. Thus, the purging amount of fuel vapor is not reduced unnecessarily, as in the case of the prior art apparatus. Therefore, it is possible to carry out a speedy purging of fuel vapor contained in the charcoal canister 42 so that fuel consumption of the internal combustion engine can be reduced to a smaller level.

As shown in FIG.6, according to the present invention, when the feedback correction factor FAF is greater than 1.0 and the air fuel mixture is at a lean-side level, the duty factor is increased to increase the purging amount of fuel vapor as much as possible. When the feedback correction factor FAF is smaller than 1.0 and the air fuel mixture is at a rich-side level, the purge correction amount KPG is increased to maintain the air-fuel ratio at the stoichiometric level.

In addition, the VSV valve controlling routine as shown in FIG.3 is executed only when the idle switch is turned ON. When the idle switch is turned OFF, this routine is not executed, and in such a case, the duty factor DPG is determined from the engine speed NE and the flow rate of intake air, with reference to a predetermined map describing a relationship between the engine speed and the intake air flow rate. In the present embodiment of the evaporative fuel control apparatus, when the intake air flow rate is relatively large, only the calculation of the purge correction amount is performed. However, the present invention is not limited to the above described embodiment, and it is a matter of course that, even when the idle switch is turned off, both the VSV control routine and the purge correction amount calculation routine can be executed.

As described above, the evaporative fuel control apparatus according to the present invention can convergently maintain the air fuel mixture at the stoichiometric air-fuel ratio, even when the air fuel mixture is very lean and the fuel vapor concentration is very low. Thus, it is possible to convergently maintain the air-fuel ratio at the stoichiometric value, and as a result the evaporative fuel control apparatus of the present invention can be suitably put into practical use.

Further, the present invention is not limited to the above described embodiment, and variations and modifications may be made without departing from the scope of the present invention.

What is claimed is:

1. An evaporative fuel control apparatus comprising:

detection means for detecting operating conditions of an internal combustion engine and for supplying signals indicative of said operating conditions;

purge means for controlling a flow of fuel vapor from a fuel tank into an intake passage of the internal combustion engine;

calculation means for calculating a fuel injection amount in response to said signals supplied by said detection means;

fuel injection control means for varying a feedback correction factor of an air-fuel ratio of air fuel mixture, in response to said signals supplied by said detection means, so as to maintain the air-fuel ratio at a stoichiometric value, and for correcting the fuel injection amount being calculated by the calculation means on the basis of the varied feedback correction factor;

purge correction means for correcting a purging amount of fuel vapor which is fed by said purge means into the intake passage, in response to the feedback correction factor varied by the fuel injection control means, so that the feedback correction factor is adjusted to be within a predetermined range; and prohibition means for preventing said purge correction means from correcting said purging amount of fuel vapor when the feedback correction factor is not within said predetermined range and it is determined based on said signals that the feedback correction factor has changed from a value outside the predetermined range to a value within the predetermined range.

2. The apparatus as claimed in claim 1, wherein said purge correction means adjusts a duty factor of a second signal, supplied to said purge means, in response to the feedback correction factor of the air-fuel ratio varied by said fuel injection means, so that said purging amount of fuel vapor is corrected, said purging amount of fuel vapor changing by a purge correction amount, and said fuel injection amount being calculated by said calculation means from said purge correction amount.

3. The apparatus as claimed in claim 1, wherein said purge means is made of an electric vacuum switching valve.

4. The apparatus as claimed in claim 3, wherein said purge means is mounted at an intermediate portion of a vapor supply conduit connecting a canister with a portion of the intake passage downstream of a throttle valve provided therein.

5. The apparatus as claimed in claim 1, wherein said detection means comprises an oxygen sensor mounted in an exhaust passage of the internal combustion engine for detecting a concentration of oxygen in exhaust gas and for supplying a signal indicative of said oxygen concentration, and a pressure sensor mounted downstream of a throttle position sensor in the intake passage for detecting intake air pressure and for supplying a signal indicative of said intake air pressure.

6. The apparatus as claimed in claim 2, wherein said purge correction amount is decreased to increase the fuel injection amount when said feedback correction factor is greater than a high reference level which is preset at above 1.0, and said purge correction amount remains unchanged to prevent the fuel injection amount from being increased excessively when said feedback correction factor is greater than 1.0 and smaller than said high reference level.

7. The apparatus as claimed in claim 2, wherein said purge correction amount is increased and said duty factor is decreased to decrease the fuel injection amount when said feedback correction factor is smaller than a low reference level which is preset at below 1.0, and said purge correction amount is increased and said duty factor remains unchanged to decrease the fuel injection amount when said feedback correction factor is greater than said low reference level and smaller than 1.0.

* * * * *

UNITED STATES PATENT AND TRADEMARK OFFICE

CERTIFICATE OF CORRECTION

PATENT NO. : 5,150,686

DATED : September 29, 1992

INVENTOR(S) : Koji OKAWA, et al.

It is certified that error appears in the above-indentified patent and that said Letters Patent is hereby corrected as shown below:

Column 2, line 3, change "becomes" to --become--.

Column 3, line 1, change "sorbinq" to --sorbing--.

Column 4, line 29, change "I/0" to --I/O--.

Column 4, line 33, change "I/0" to --I/O--.

Column 4, line 38, change "timing signal" to --timing signals--.

Column 4, line 66, change "I/0" to --I/O--.

Column 5, line 38, change "I/0" to --I/O--.

Column 10, line 65, change "is" to --it--.

Signed and Sealed this

Twelfth Day of September, 1995

*Attest:*

Bruce Lehman

BRUCE LEHMAN

*Attesting Officer*

*Commissioner of Patents and Trademarks*